United States Patent [19]

Castelli

[11] Patent Number: 4,829,728

[45] Date of Patent: May 16, 1989

[54] SOUNDPROOF STRUCTURE FOR GENERIC INTERIOR FACING, AND PARTICULARLY FOR SO-CALLED OPEN-SPACE WORKING, INTERIORS

[76] Inventor: Clino T. Castelli, Via Tivoli, 8-Milano, Italy

[21] Appl. No.: 38,056

[22] Filed: Apr. 14, 1987

[51] Int. Cl.[4] ..... E04B 1/82

[52] U.S. Cl. ..... 52/145; 181/289; 181/295

[58] Field of Search ..... 52/144, 145; 181/289, 181/295

[56] References Cited

U.S. PATENT DOCUMENTS

| | | | |
|---|---|---|---|
| 2,007,130 | 7/1935 | Munroe | 52/144 |
| 2,710,335 | 6/1955 | Wong | 52/144 |
| 3,068,956 | 12/1962 | Cooley | 52/144 |
| 3,460,299 | 8/1969 | Wilson | 52/144 |
| 3,696,571 | 10/1972 | Schluter | 52/144 |
| 3,903,660 | 9/1975 | Akins | 52/144 |
| 4,318,946 | 3/1982 | Pavone | 52/311 |
| 4,598,010 | 7/1986 | Ollinger | 52/144 |

FOREIGN PATENT DOCUMENTS

| | | | |
|---|---|---|---|
| 497476 | 12/1950 | Belgium | 52/144 |
| 2339399 | 1/1975 | Fed. Rep. of Germany | 52/144 |
| 365858 | 1/1963 | Switzerland | 52/144 |

OTHER PUBLICATIONS

Armstrong Antique Glass Tile Sweet's Catalog File 1979 Edition Section 9.1 AR p. 44.

USG Sound Control Ceilings Sweet's Catalog File 1979 9.1/uha p. 20.

*Primary Examiner*—Henry E. Raduazo

*Attorney, Agent, or Firm*—Thomas & Kennedy

[57] ABSTRACT

A soundproof structure is provided at its surface with a lining of a catadioptric material which forms a light source when a light beam impinges on it.

2 Claims, 2 Drawing Sheets

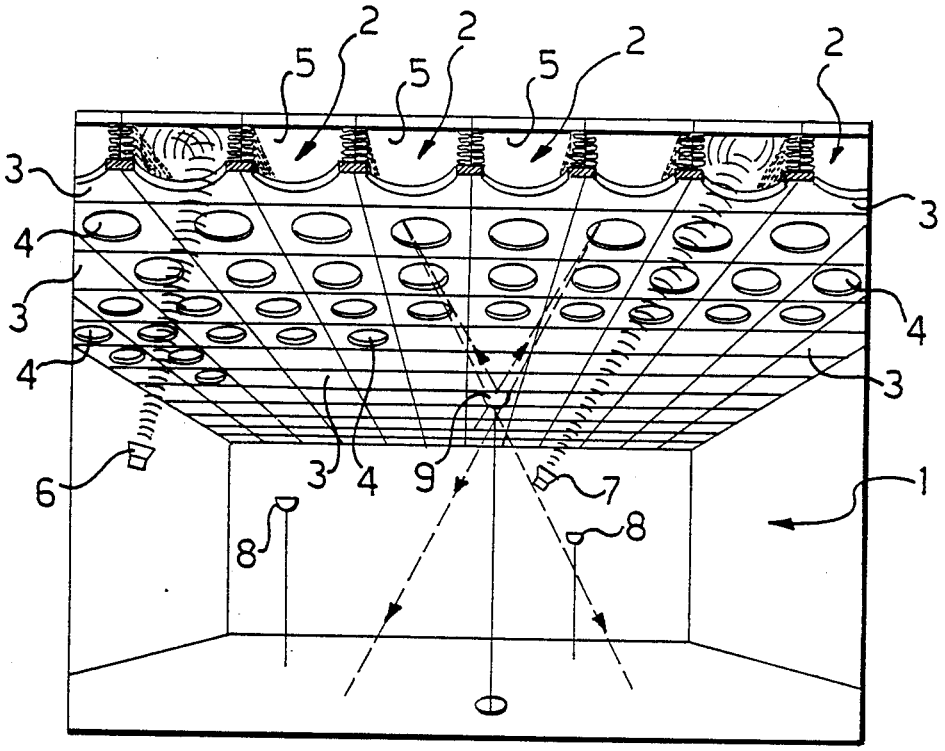
Fig-1
Fig-2
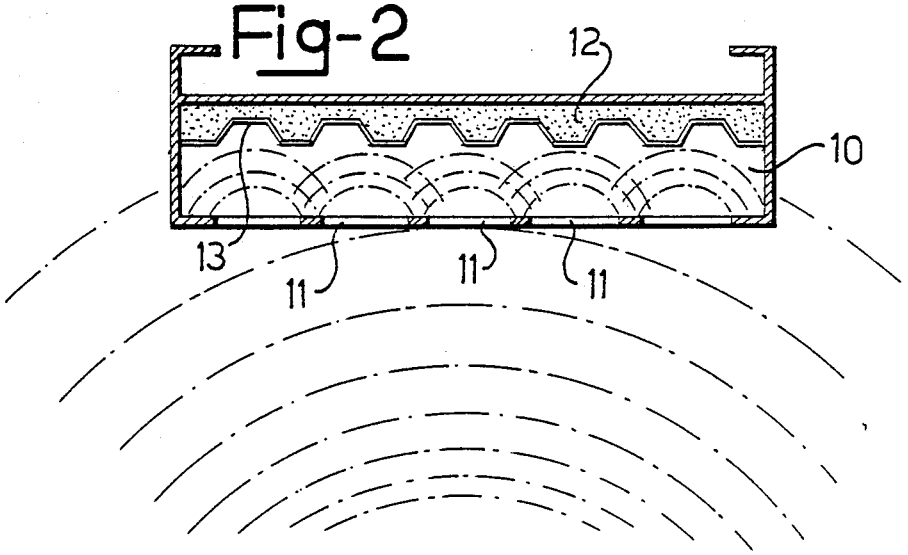

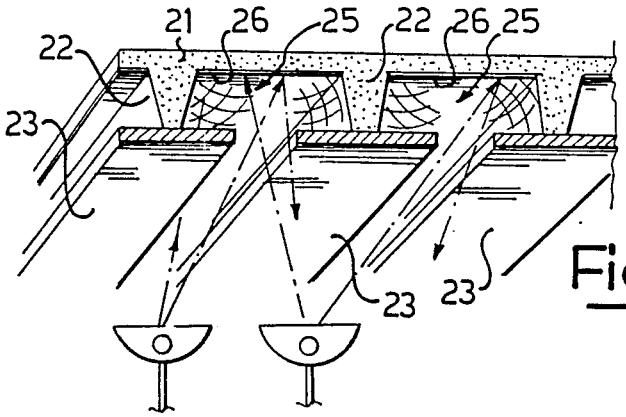
Fig-3
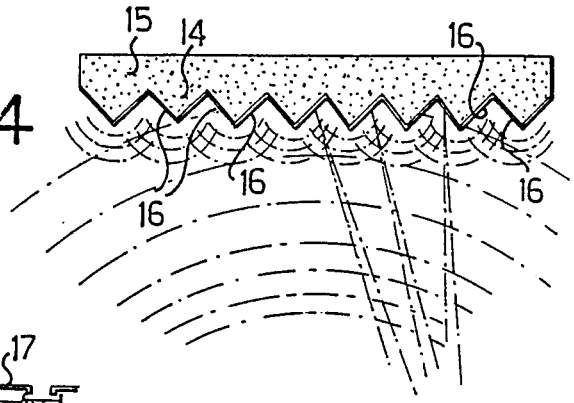
Fig-4
Fig-5
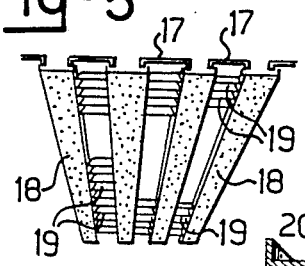
Fig-7
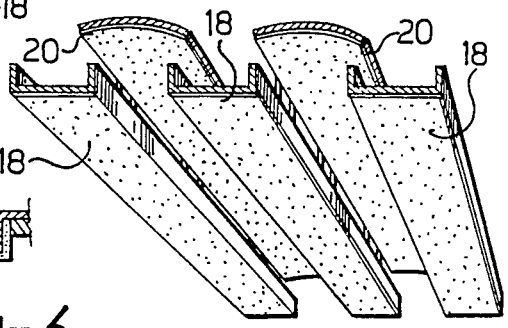
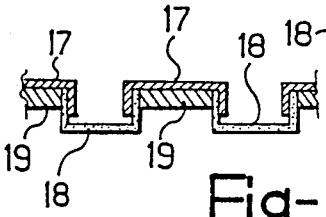
Fig-6

SOUNDPROOF STRUCTURE FOR GENERIC INTERIOR FACING, AND PARTICULARLY FOR SO-CALLED OPEN-SPACE WORKING, INTERIORS

DESCRIPTION

This invention relates to a soundproof structure for facing the ceilings and walls of generic interiors, in particular so-called open-space working interiors.

It is a known fact that soundproof structures are gaining ever-increasing acceptance for facing working interior spaces of the kind specified above, on account of their well-recognized advantages at both the level of personal comfort and, above all, of work efficiency.

Also known is that the most effective of soundproof structures are those which afford the highest number of sound "traps". In fact, structures have been proposed which comprise composite panels defining plural cells, accessible from the working interior space, into which sound becomes trapped almost completely. Other soundproof structures comprise deeply "wrought" surfaces, and specifically foam material boards, for example, which have their surfaces facing the interior space formed with plural pyramid- or cusp-like projections arranged in rows and arrays and having varying depth dimensions.

Unfortunately, those same sound traps, as provided by the aforesaid soundproof structures, are also effective "light traps". It is indeed a generally recognized, and readily ascertainable, fact that the intensity of a light beam impinging on such a soundproof structure undergoes drastic attenuation in the beam reflected back toward the interior space.

Actually, the requirements for soundproofing and lighting an interior space are definitely contradictory and irreconcilable ones. Lighting, to even a barely adequate extent, an interior space otherwise well set up from the soundproofing standpoint, involves high energy expenditure.

Prior proposals directed to solve the problem of reconciling the aforesaid conflicting requirements simultaneously within a given interior space have been heretofore in the nature of a compromise lying far from optimum. The problem, moreover, is further aggravated where an open-space working interior under consideration accommodates working stations equipped with video terminals or the like apparatus including display monitors, which necessitate exceptionally strict lighting conditions to cope with the increased visual commitment of their operators and the marked reflectivity of display monitors.

To definitely solve this technical problem, this invention provides a soundproof structures for working interior facing, and particularly for so-called open-space interiors, characterized in that its surface is lined at least in part with a layer of a retro reflective material. The term "retro reflective" material, as used herein, refers to materials that exhibit the property of retro-reflection, i.e., that reflect a beam of light incident upon the material back in the direction towards the source of the incident beam. Such materials are commonly available and are often used on road signs so that incident light from the headlights of cars is reflected back in the direction of the car thereby making the sign appear bright to its driver. One example of such a material is that produced by the 3M Corporation and marketed under the trade name Scotchlite Reflective Film.

In the soundproof structure of this invention, the layer of retro reflective material forms a light source on a light beam impinging on it. Furthermore, by virtue of the recognized properties of said material, the lighting effectiveness of such a light source is quite unaffected by the more or less wrought character of the soundproof structure employed because an incident beam is always reflected back to its source regardless of the angle between the incident beam and the surface.

This affords the important advantage that the entire range of the presently available soundproof structures can be used successfully to achieve a desired degree of deadening against noise propagation, always accompanied by a high lighting efficiency which is the equal of or even greater than that to be obtained in non-soundproofed interiors.

The invention features and advantages will be more clearly understood from the following detailed description of some embodiments of the soundproof structure according to the invention, given herein with reference to the accompanying illustrative and not limitative drawings, where:

FIG. 1 is a perspective view showing diagramatically an open-space working interior provided with a ceiling incorporating the soundproof structure of this invention;

FIG. 2 is a cross-section view showing diagramatically a modified embodiment of the soundproof structure of FIG. 1;

FIG. 3 shows in perspective, and partly in section, a further embodiment of the soundproof structure according to this invention;

FIG. 4 shows diagramatically yet another embodiment of the inventive soundproof structure;

FIGS. 5 and 6 show diagramatically in perspective view and in cross-section, respectively, another modified embodiment of the soundproof structure according to the invention; and FIG. 7 shows another embodiment of the inventive soundproof structure.

With reference to FIG. 1, a soundproof structure according to this invention has been used to face the ceiling of an interior space 1, e.g. a so-called open-space working interior. The soundproof structure comprises a plurality of substantially box-like cells which are orderly arranged in parallel rows and arrays and are each provided, at their wall 3 confronting the working interior 1, with a circular opening 4. The inner wall of each cell 3 lying remotely from its respective circular opening 4 is lined with a layer 5 of a retro reflective material (e.g., a retro reflective film, retro reflective paint, etc.).

Schematically depicted within the working interior 1 are some "noise" sources 6, 7, with some light sources being indicated at 8 and 9. The acoustic wave is represented schematically by a succession of curved lines, whilst light radiation is represented by broken lines.

The cells 2 are known to form highly effective traps for the acoustic waves which enter them through the openings 4.

These same cells 2 are also penetrated, through the openings 4, by the light radiation from the sources 8 and 9, but this radiation is not trapped within the cells because, after impinging on the retro reflective surfaces 5, it is reflected thereby back in the direction of its source and out of the cells. Substantially all of the light that enters the cell through the opening is reflected back out of the opening and into the room rather than being trapped and absorbed in the cell. The retro reflective material layer 5 of each cell 2 substantially forms a light source which contributes toward lighting the working interior 1 along with the rest of such like sources.

In the soundproof structure shown in FIG. 2, a single large size cell 10, accessible from the outside through a plurality of openings 11, accommodates a layer 12 of a soundproofing material whose wall facing the working interior space has been "wrought" with a plurality of projections and recesses which, when viewed in cross-section, impart to it a substantially fretted pattern. This wall is completely covered by a layer 13 of a retro reflective material.

In the soundproof structure of FIG. 3, a panel 21 of a foam material is formed with a plurality of ribs 22 delimiting, in cooperation with a plurality of flat staves 23, a corresponding plurality of cells 25.

The staves 23 are set apart to define an access passage to the cells 25. The walls of the cells 25 remote from said passages, are provided with a layer 26 of a retro reflective material.

The soundproof structure embodiment of FIG. 4 comprises a panel 15 of a foam material whose wall facing the working interior space is formed with a plurality of pyramidal cusp projections 14 orderly laid in parallel rows and arrays. The outer walls of each cusp 14 have respective linings 16 of a retro reflective material such that light incident on the structure is reflected back into the room rather than being reflected and absorbed by the uneven surface of the structure.

The soundproof structures shown in FIGS. 5 to 7 are of the so-called staved type (indicated at 17, 18 and 20, respectively, in said Figures), which is highly effective to trap sound. More specifically, the soundproof structures of FIGS. 5 and 6 are provided with a plurality of sound breaking reeds 19. In accordance with this invention, the staves and sound breaking reeds are both lined with respective layers of a retro reflective material.

I claim:

1. In a structure for controlling the level of sound in a room with the structure being of the type having a plurality of sound absorbing cells with each cell being in fluid communication with the room through an opening in the cell, The Improvement Comprising a coating of retro reflective material being formed on an interior surface of each cell opposite said opening whereby light entering the cells through the openings is principally reflected by said material directly back through the opening and into the room while sound entering the cell is absorbed.

2. A sound absorbent, light nonabsorbent cell adapted to be mounted to a room ceiling or wall for suppressing sound without substantially attenuating room lighting, and with said cell having a plurality of walls that define an interior open space within said cell, one of said walls having an opening through which sound and light may enter the cell, and a second of said walls being at least partially coated with a retro reflective material to reflect most light intercepted by the retro reflective material directly back out of the opening.

* * * * *